US009032728B2

(12) United States Patent
Nakayasu et al.

(10) Patent No.: US 9,032,728 B2
(45) Date of Patent: May 19, 2015

(54) SUPERCHARGER LUBRICATING STRUCTURE FOR INTERNAL COMBUSTION ENGINE

(75) Inventors: Tetsuya Nakayasu, Saitama (JP); Shunsuke Muroi, Saitama (JP)

(73) Assignee: HONDA MOTOR CO., LTD., TOKYO (JP)

( * ) Notice: Subject to any disclaimer, the term of this patent is extended or adjusted under 35 U.S.C. 154(b) by 964 days.

(21) Appl. No.: 12/850,061

(22) Filed: Aug. 4, 2010

(65) Prior Publication Data

US 2011/0048387 A1 Mar. 3, 2011

(30) Foreign Application Priority Data

Aug. 18, 2009 (JP) ..... 2009-189156

(51) Int. Cl.

| | |
|---|---|
| ***F02B 33/44*** | (2006.01) |
| ***F02B 33/00*** | (2006.01) |
| ***F01C 1/02*** | (2006.01) |
| ***F02B 33/36*** | (2006.01) |
| ***F01M 1/06*** | (2006.01) |
| ***F02B 39/14*** | (2006.01) |

(52) U.S. Cl.

CPC ..... *F02B 33/36* (2013.01); *F01M 1/06* (2013.01); *F01M 2001/062* (2013.01); *F02B 39/14* (2013.01)

(58) Field of Classification Search

CPC .... F01M 1/06; F01M 2001/062; F02B 39/14; F02B 33/36

USPC ..... 60/605.3, 624; 418/55.1; 123/559.1

See application file for complete search history.

(56) References Cited

U.S. PATENT DOCUMENTS

| | | | | |
|---|---|---|---|---|
| 3,673,798 | A * | 7/1972 | Kuehl | 60/605.1 |
| 4,432,205 | A * | 2/1984 | Inoue et al. | 60/605.1 |
| 4,716,735 | A * | 1/1988 | Ruf et al. | 60/605.3 |
| 5,024,589 | A * | 6/1991 | Jetzer et al. | 418/55.3 |
| 8,245,511 | B2 * | 8/2012 | Cowland et al. | 60/624 |
| 2006/0054146 | A1 * | 3/2006 | Ozawa | 123/559.1 |
| 2006/0060170 | A1 * | 3/2006 | Ozawa | 123/559.1 |
| 2010/0275890 | A1 * | 11/2010 | McDonald-Walker | 123/564 |

FOREIGN PATENT DOCUMENTS

| | | | |
|---|---|---|---|
| JP | 04081588 | A | 3/1992 |
| JP | 2007285247 | A * | 11/2007 |

* cited by examiner

*Primary Examiner* — Thai Ba Trieu
*Assistant Examiner* — Paolo Isada
(74) *Attorney, Agent, or Firm* — Squire Patton Boggs (US) LLP

(57) ABSTRACT

A supercharger lubricating structure for an internal combustion engine is provided that can supply oil to a supercharger through a short oil passage without use of external piping and downsize a lubricating oil pump. A supercharger lubricating structure for an internal combustion engine can be characterized by the following: A rotating shaft can be connected to a crankshaft via a joint. A connection pipe can be insertably passed through the crankshaft and the rotating shaft to allow an intra-crankshaft oil-feed passage and an intra-rotating-shaft oil-feed passage to communicate with each other. An eccentric shaft portion can be provided on the rotating shaft. A supercharger composed of an orbiting movable scroll and front and rear fixed scrolls can be provided on the eccentric shaft portion via needle bearings. The front and rear fixed scrolls can be provided with ball bearings and the needle bearing supporting the rotating shaft. Oil passages can be disposed to allow the intra-rotating-shaft oil-feed passage, the ball bearing, the needle bearing and the needle bearings to communicate with one another.

13 Claims, 7 Drawing Sheets

SUPERCHARGER LUBRICATING STRUCTURE FOR INTERNAL COMBUSTION ENGINE

CROSS REFERENCE TO RELATED APPLICATIONS

The present application is related to and claims the priority of Japanese Patent Application No. 2009-189156 filed Aug. 18, 2009, which is hereby incorporated by reference in its entirety.

BACKGROUND

1. Field

The present invention relates to a supercharger lubricating structure for an internal combustion engine.

2. Description of the Related Art

Some internal combustion engines use a scroll-type supercharger to pressurize fresh air to pressure higher than ambient atmospheric pressure for supply. Some superchargers of this type are known to have a structure in which a needle bearing supporting a hub portion of a rotor can be disposed at the center of a shaft and lubricating oil can be supplied to the needle bearing.

SUMMARY

Certain embodiments of the present invention relate to a supercharger lubricating structure for an internal combustion engine. A supercharger includes a rotating shaft connected to a crankshaft via a joint, an eccentric shaft portion provided on the rotating shaft, a movable scroll provided on the eccentric shaft portion so as to be orbited via a scroll bearing, and a fixed scroll provided to correspond to the movable scroll, wherein the movable scroll and the fixed scroll are configured to supply compressed air to an intake port of the internal combustion engine. The supercharger lubricating structure for an internal combustion engine includes an intra-crankshaft oil-feed passage disposed in the crankshaft. The supercharger lubricating structure for an internal combustion engine also includes a support bearing provided on the fixed scroll so as to support the rotating shaft. The supercharger lubricating structure for an internal combustion engine further includes an intra-rotating-shaft oil-feed passage disposed in the rotating shaft. The supercharger lubricating structure for an internal combustion engine additionally includes a bearing oil-feed passage configured to bring the intra-rotating-shaft oil-feed passage, the support bearing, and the scroll bearing into communication with one another. The supercharger lubricating structure for an internal combustion engine also includes a connection pipe disposed inside the crankshaft and the rotating shaft. The intra-crankshaft oil-feed passage is communication-connected to the intra-rotating-shaft oil-feed passage via an intra-connection-pipe oil-feed passage disposed inside the connection pipe.

In further embodiments, the present invention is a supercharger lubricating structure for an internal combustion engine. A supercharger includes a rotating shaft connected to a crankshaft via a joint, an eccentric shaft portion provided on the rotating shaft, a movable scroll provided on the eccentric shaft portion so as to be orbited via a scroll bearing, and a fixed scroll provided to correspond to the movable scroll, wherein the movable scroll and the fixed scroll are configured to supply compressed air to an intake port of the internal combustion engine. The supercharger lubricating structure for an internal combustion engine includes crankshaft passage means for feeding oil intra-crankshaft provided in the crankshaft. The supercharger lubricating structure for an internal combustion engine also includes bearing means for supporting the rotating shaft provided on the fixed scroll. The supercharger lubricating structure for an internal combustion engine further includes rotating-shaft passage means for feeding oil intra-rotating-shaft disposed in the rotating shaft. The supercharger lubricating structure for an internal combustion engine additionally includes bearing passage means for feeding oil to the scroll bearing, wherein the bearing passage means is configured to bring the rotating-shaft passage means, the bearing means, and the scroll bearing into communication with one another. The supercharger lubricating structure for an internal combustion engine also includes connection means for piping oil, wherein the connection means is disposed inside the crankshaft and the rotating shaft. The crankshaft passage means is communication-connected to the rotating-shaft passage means via connection passage means for feeding oil within the connection means is disposed inside the connection means.

In additional embodiments, the present invention relates to a method for lubricating a supercharger for an internal combustion engine. A supercharger includes a rotating shaft connected to a crankshaft via a joint, an eccentric shaft portion provided on the rotating shaft, a movable scroll provided on the eccentric shaft portion so as to be orbited via a scroll bearing, and a fixed scroll provided to correspond to the movable scroll, wherein the movable scroll and the fixed scroll are configured to supply compressed air to an intake port of the internal combustion engine. The method includes feeding oil though an intra-crankshaft passage provided in the crankshaft, wherein a support bearing is disposed on the fixed scroll so as to support the rotating shaft. The method also includes feeding oil through an intra-rotating-shaft oil-feed passage disposed in the rotating shaft. The method further includes feeding oil to the scroll bearing through a bearing oil-feed passage, wherein the bearing oil-feed passage is configured to bring the intra-rotating-shaft oil-feed passage, the support bearing, and the scroll bearing into communication with one another. The method additionally includes piping oil through a connection pipe disposed inside the crankshaft and the rotating shaft, wherein the intra-crankshaft oil-feed passage is communication-connected to the intra-rotating-shaft oil-feed passage via an intra-connection-pipe oil-feed passage disposed inside the connection pipe.

BRIEF DESCRIPTION OF THE DRAWINGS

For proper understanding of the invention, reference should be made to the accompanying drawings, wherein.

DETAILED DESCRIPTION OF THE PREFERRED EMBODIMENT(S)

Figure 1:
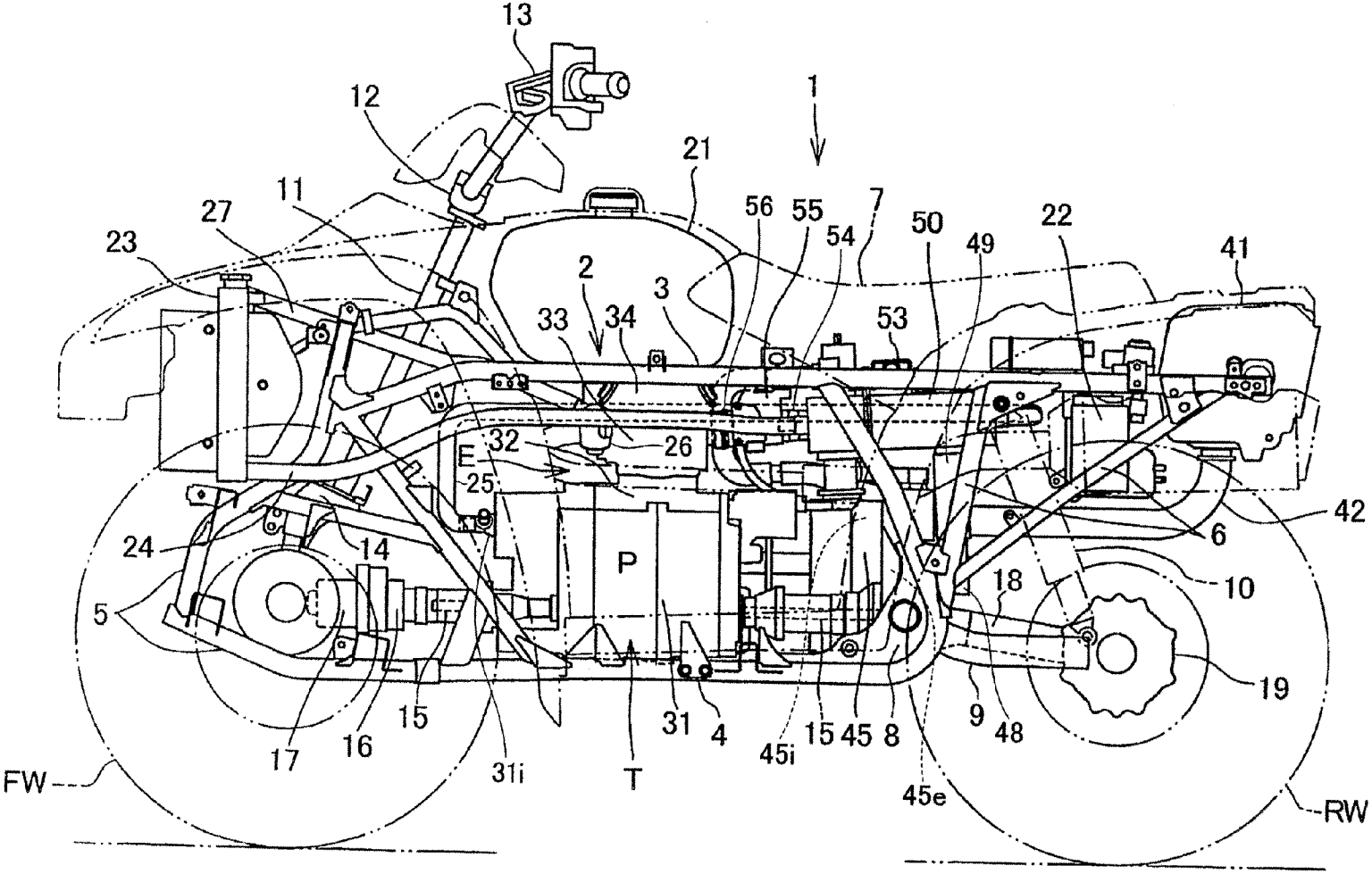
FIG. 1 is a lateral view of a four-wheeled buggy vehicle according to various embodiments of the present invention.

To mount the traditional supercharger mentioned above to the internal combustion engine, it may be necessary to connect an oil passage adapted to lubricate the needle bearing with the internal combustion engine by means of external piping. If the structure of supplying lubricating oil via separate external piping is adopted, the number of component parts is increased and the arrangement of piping becomes cumbersome, which can lead to increased weight and costs. In addition, the arrangement of the external piping increases the length of piping. If hydraulic pressure is low, a sufficient amount of feed-oil cannot be ensured. It may be necessary, therefore, to increase the power of a lubricating oil pump.

Accordingly, certain embodiments of the present invention provide a supercharger lubricating structure for an internal combustion engine that can supply oil to a supercharger through a short oil passage without use of external piping and downsize a lubricating oil pump.

Thus, in certain embodiments, in a supercharger lubricating structure for an internal combustion engine, in which a supercharger (e.g. the supercharger 45 in FIG. 3) includes a rotating shaft (e.g. the rotating shaft 101 in FIG. 3) connected to a crankshaft (e.g. the crankshaft 20 in FIG. 3) via a joint (e.g. the joint 103 in FIG. 3), an eccentric shaft portion (e.g. the eccentric shaft portion 126 in FIG. 3) provided on the rotating shaft, a movable scroll (e.g. the movable scroll 116 in FIG. 3) provided on the eccentric shaft portion so as to be orbited via a scroll bearing (e.g. the needle bearing 130 in FIG. 4), and a fixed scroll (e.g. front and rear fixed scrolls 115F, 115R) provided to correspond to the movable scroll, and the movable scroll and the fixed scroll supply compressed air to an intake port (e.g. the intake port 57 in FIG. 3) of the internal combustion engine (e.g. the internal combustion engine E in FIG. 3), an intra-crankshaft oil-feed passage (e.g. the intra-crankshaft oil-feed passage 112) can be formed or otherwise disposed in the crankshaft, a support bearing (e.g. the ball bearing 110 and the needle bearing 111 in FIG. 3) can be provided on the fixed scroll so as to support the rotating shaft, an intra-rotating-shaft oil-feed passage (e.g. the intra-rotating-shaft oil-feed passage 123 in FIG. 4) can be formed in the rotating shaft, a bearing oil-feed passage (e.g. oil passages 145, 146, 150 in FIG. 4) can be formed to bring the intra-rotating-shaft oil-feed passage, the support bearing and the scroll bearing into communication with one another, a connection pipe (e.g. the connection pipe 140, 140' in FIGS. 4 and 5 respectively) can be disposed inside the crankshaft and the rotating shaft, and the intra-crankshaft oil-feed passage can be communication-connected to the intra-rotating-shaft oil-feed passage via an intra-connection-pipe oil-feed passage (e.g. intra-connection-pipe oil-feed passage 144 in FIG. 4) formed inside the connection pipe.

According to such an embodiment, oil supplied to the supercharger does not require the use of external piping; therefore, piping can be simplified. In addition, reduction of piping length is possible; therefore, oil-feed can be performed without excessively increasing the power of the lubricating oil pump of the internal combustion engine.

Figure 4:
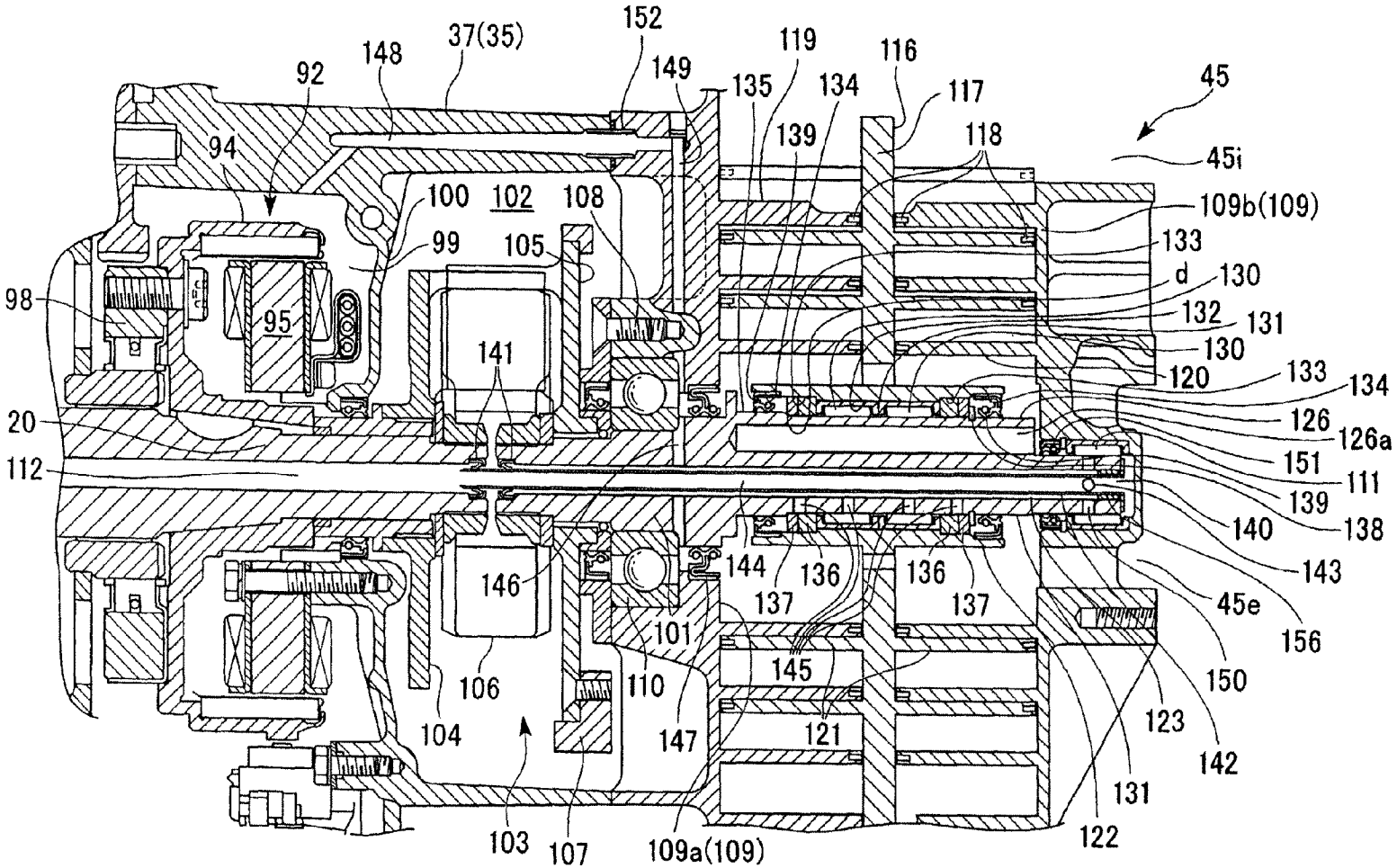
FIG. 4 is an enlarged cross-sectional view of a particular portion of FIG. 3.
Figure 5:
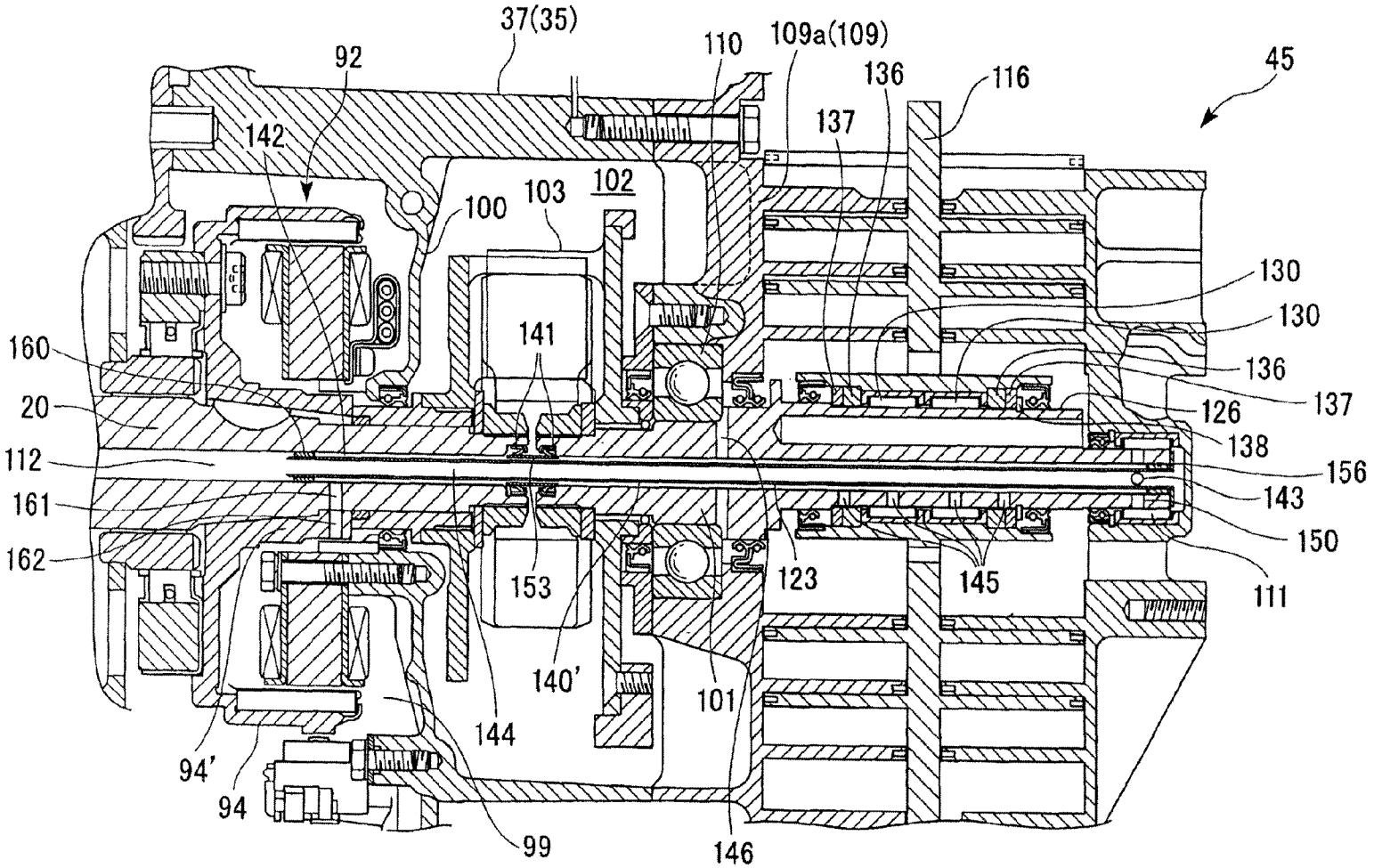
FIG. 5 is a cross-sectional view corresponding to FIG. 4 of a second embodiment of the present invention.

In a further embodiment, an extra-connection-pipe oil-feed passage (e.g. extra-connection-pipe oil-feed passage 142 in FIG. 4) can be formed, or otherwise disposed, between the connection pipe and the intra-rotating-shaft oil-feed passage to allow a downstream side of the extra-connection-pipe oil-feed passage to communicate with a lubricating oil return passage (e.g. the lubricating oil return passage 148, 161 in FIGS. 4 and 5, respectively).

According to such an embodiment, the oil passage can be formed between the connection pipe and the intra-rotating-shaft oil-feed passage; therefore, the lubricating oil passage adapted to return oil toward the internal combustion engine can be simplified.

In an additional embodiment, the intra-connection-pipe oil-feed passage and the extra-connection-pipe oil-feed passage may be allowed to communicate with each other on a side opposite the crankshaft with the scroll bearing put therebetween.

According to such an embodiment, the lubricating oil passes through the passage adapted to feed oil to the scroll bearing before flowing toward the internal combustion engine. This may reliably lubricate the scroll bearing.

In a further embodiment, a communication portion (e.g. the communication hole 143 in FIG. 4) adapted to allow the intra-connection-pipe oil-feed passage and the extra-connection-pipe oil-feed passage to communicate with each other can be set at a position of the support bearing of the rotating shaft on a side opposite the crankshaft with the scroll bearing put therebetween.

According to such an embodiment, the lubricating oil passes through the support bearing of the rotating shaft before flowing toward the internal combustion engine. A reliable supply of oil to the support bearing may therefore be possible.

In another embodiment, a generator (e.g. the generator 92 in FIG. 3) can be disposed adjacently to the joint on the crankshaft, and the lubricating oil return passage opens toward the generator.

According to such an embodiment, the oil-feed passage for cooling the generator may be simplified.

In a further embodiment, a casing (e.g. the supercharger casing 109 in FIG. 3) of the supercharger can be joined to a crankcase (e.g. the crankcase 31 in FIG. 3) of the internal combustion engine and the crankcase and the casing of the supercharger define a joint housing chamber (e.g. the joint housing chamber 102 in FIG. 3) housing the joint therein.

According to such an embodiment, the joint can easily be protected by the crankcase and the casing of the supercharger.

In an additional embodiment, the joint housing chamber can be adjacent to a generator chamber (e.g. the generator chamber 99 in FIG. 3) provided in the crankcase to house the generator therein and the lubricating oil return passage can be formed in the joint housing chamber.

According to such an embodiment, the lubricating oil return passage may be formed in a simple manner.

Figure 2:
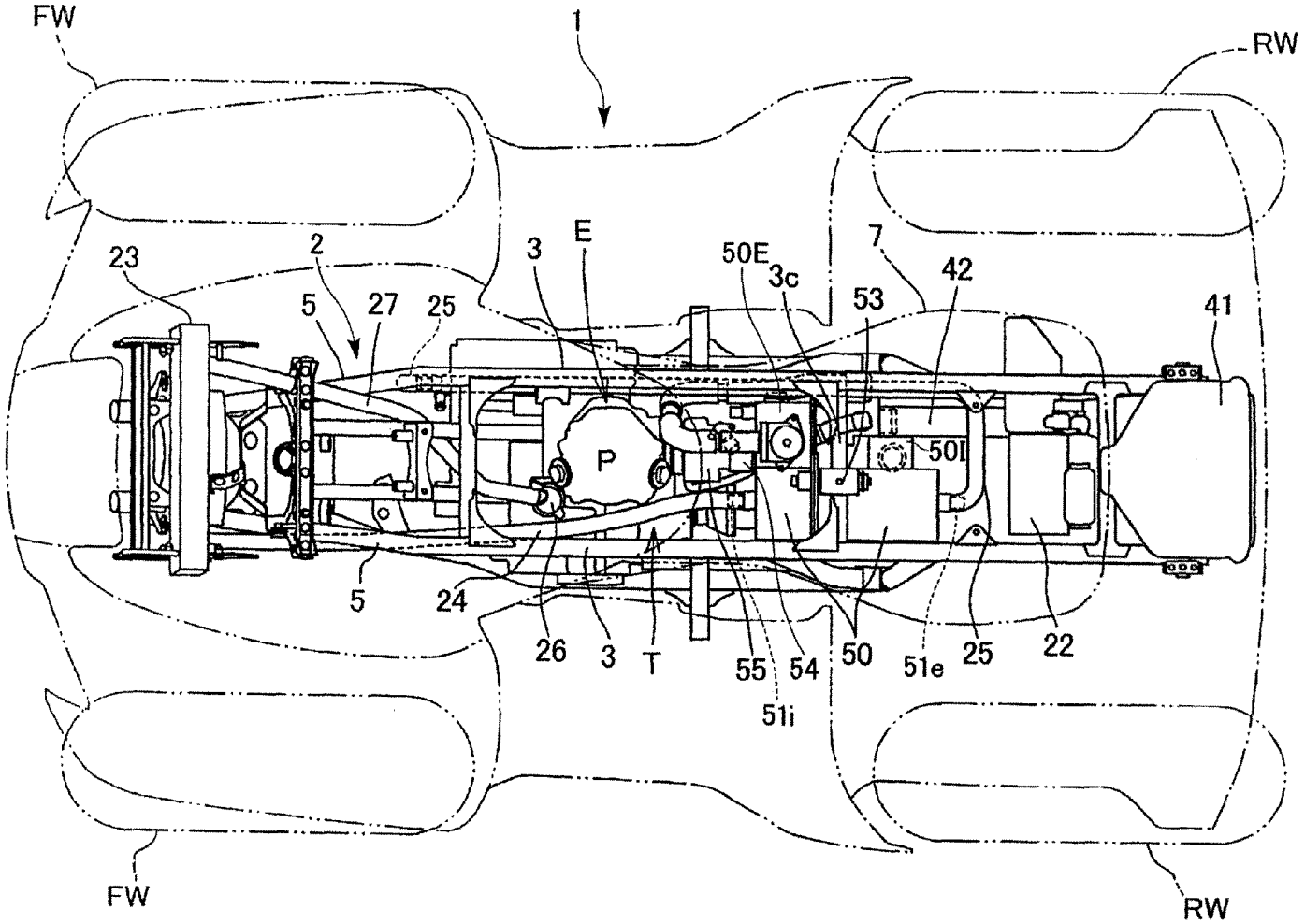
FIG. 2 is a plan view of FIG. 1.

FIG. 1 is a lateral view of a four-wheeled straddle-ride type vehicle provided with a supercharger-equipped internal combustion engine according to certain embodiments of the present invention. FIG. 2 is a lateral view of FIG. 1. A vehicle 1 has a pair of left and right front wheels FW and a pair of left and right rear wheels RW which can be suspended by the front and rear of a body frame 2. Low-pressure balloon tires for rough terrain traveling can be attached to the front wheels FW and the rear wheels RW.

The body frame 2 is, as illustrated, such that a pair of left and right main frames 3, 3 extend in a back and forth direction from the front portion to rear portion of the vehicle body. Center frame portions 4, 4 can be provided to form a framework in a parallelogram as viewed from the side with the central portions of the main frames 3, 3 serving as upper sides. The main frames 3, 3 and the center frame portions 4, 4 support a power unit P in which an internal combustion engine E and a transmission T can be configured integrally with each other in a crankcase 31.

Front frames 5, 5 are, as shown in FIGS. 1-2, joined to the respective front portions of the main frames 3, 3 and of the center frame portions 4, 4. The front frames 5, 5 suspend the front wheels FW. Rear portions of the main frames 3, 3 supporting a straddle-ride seat 7 can be supported by rear frame portions 6, 6 interposed between rear lower end portions of the center frame portions 4, 4 and the rear portions of the main frames 3, 3.

A pivot plate 8 can be secured to a bent portion of a rear lower end of the center frame portion 4. A swing arm 9 can be provided and can be swingably supported at its front end by the pivot plate 8. A rear cushion 10 can be interposed between a rear portion of the swing arm 9 and the main frame 3. The rear wheel RW, as shown in FIGS. 1-2, is suspended by a rear final reduction gear unit 19 provided at the rear end of the swing arm 9.

A head pipe 11, as illustrated in FIGS. 1-2, is supported by a widthwise central portion of a cross member spanned between the left and right front frame portions 5, 5. A steering handlebar 13 can be joined to an upper end portion of the steering shaft 12 steerably supported by the head pipe 11. A lower end of the steering shaft 12 can be joined to a front wheel steering mechanism 14.

The internal combustion engine E of the power unit P can be a water-cooled single-cylinder engine and can be mounted on the center frame portions 4, 4 in a longitudinal mount state in which a crankshaft 20 (see FIG. 3) can be oriented in the back and forth direction of the vehicle body. The crankshaft 20 can be disposed rearward of the crankcase 31 so as to be offset slightly rightward from the vehicle body center. A supercharger 45 can be disposed rearward of the crankshaft 20.

The transmission T of the power unit P is, in the particular example embodiment shown in FIGS. 1-2, disposed on the left side of the internal combustion engine E. An output shaft 15 oriented in the back and forth direction from the transmission T offset leftward projects forward and rearward. The rotational power of the output shaft 15 can be transmitted from the front end thereof via a front drive shaft 16 and a front final reduction gear unit 17 to the left and right front wheels FW. In addition, the rotational power can be transmitted from the rear end of the output shaft 15 via a rear drive shaft 18 and a rear final reduction gear unit 19 to the left and right rear wheels RW.

A fuel tank 21 can be suspended and supported above the power unit P by the front portions of the main frames 3, 3 of the body frame 2. A battery 22 can be provided to be hung by the rear portions of the main frames 3, 3 and a radiator 23 can be supported by the front portions of the front frame portions 5, 5.

An air cleaner 41 may be mounted rearward of the battery 22 by the rear ends of the main frames 3, 3.

Figure 3:
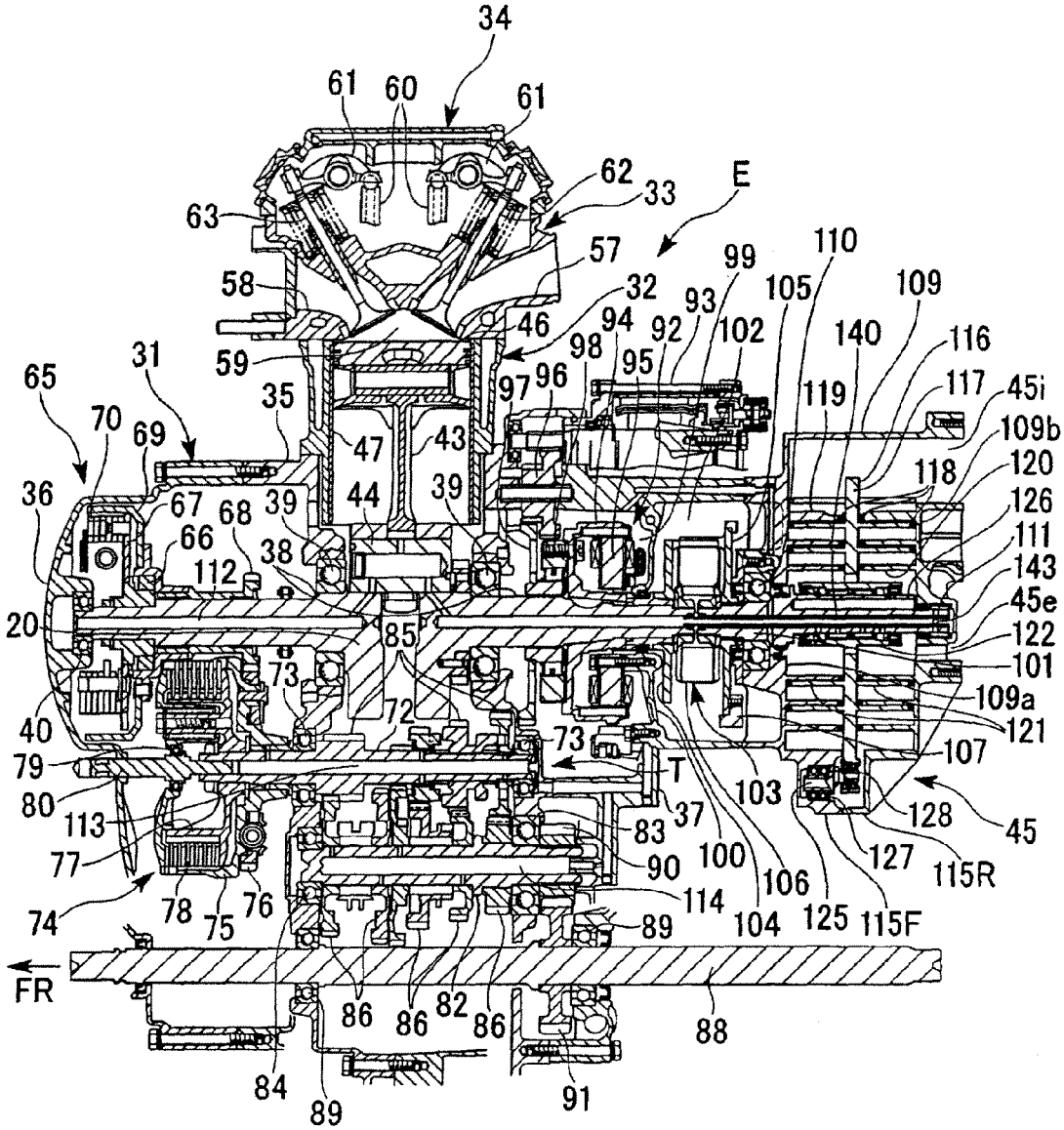
FIG. 3 is a cross-sectional view of an engine according to an embodiment of the present invention.

The internal combustion engine E is, in this example, provided uprightly in such a manner that a cylinder block 32, a cylinder head 33 and a cylinder head cover 34 are put on the crankcase 31 in this order and tilted slightly leftward (also see FIG. 3). A throttle body 55 can be joined to a short air-intake pipe 56 extending rearward from the cylinder head 33. An intercooler 50 can be disposed immediately rearward of the throttle body 55 so as to be close to the throttle body 55. The throttle body 55 and the intercooler 50 can be connected to each other via an intake connection pipe 54.

Incidentally, the throttle body 55 and the intercooler 50 can be fitted in between the left and right main frames 3, 3 as viewed from above and located below the straddle-ride seat 7.

In the embodiment shown in FIGS. 1-2, the intercooler 50 is structured to be halved back and forth and an attachment stay 53 is provided on upper portions of flange portions at a mating surface. The attachment stay 53 is attached to straddle the cross member 3*c* spanned between the main frames 3, 3. Thus, the intercooler 50 is, in this example, provided to be hung downward from the main frames 3, 3. The intercooler 50 is located above the supercharger 45 at a height-position close to the lower surface of the main frame 3 as viewed from above.

The intercooler 50 can be a rectangular device fitted in between the main frames 3, 3 and disposed on the left half portion to extend back and forth. A rectangular container protruding rightward from the rear portion of the intercooler 50 constitutes an intake side expansion chamber 501. In addition, a rectangular container protruding rightward from the front portion thereof constitutes an exhaust side expansion chamber 50E.

A throttle body 55 can be connected via the intake connection pipe 54 to the front of the exhaust side expansion chamber 50E of the intercooler 50. A discharge port of the supercharger 45 can be connected via a connection pipe 49 to the lower portion of the intake side expansion chamber 501.

In this embodiment, a cooling water inlet port 51*i* projects forward from the intercooler 50 and a cooling water outlet port 51*e* projects rearward from the intercooler 50. A radiator hose 24 adapted to receive cooling water supplied thereto from the radiator 23 can be coupled to the inlet port 51*i*. A cooling water hose 25 can be coupled to the outlet port 51*e*. The cooling water hose 25 bends rightward, then bending forward, and extends forward on the right side of the intercooler 50, the throttle body 55 and the cylinder head 33. Further, the cooling water hole 25 bends downward, extending to the front side of the crankcase 31, and connects with a cooling water inlet port 31*i* of the crankcase 31.

In the embodiment shown in FIGS. 1-2, a thermostat 26 is disposed at a left front portion of the cylinder head 33. Cooling water circulating from the crankcase 31 to the cylinder head 32 and the cylinder head 33 is led to the thermostat 26. A radiator hose 27 is, in this example, connected to between the thermostat 26 and the front radiator 23.

An intake connection pipe 42 can be coupled to the intake port 45*i* of the supercharger 45 and extends between the intake port 45*i* and the air cleaner 41. In addition, the discharge port 45*e* of the supercharger 45 can be connected to the intake side expansion chamber 501 of the intercooler 50 via the discharge connection pipe 48 and the connection pipe 49.

FIG. 3 is a cross-sectional view of the internal combustion engine and the supercharger and FIG. 4 is an enlarged cross-sectional view of a particular portion of FIG. 3. As shown in FIGS. 3 and 4, the crankcase 31 of the internal combustion engine E is composed of a crank casing 35, a front crankcase cover 36 and a rear crankcase 37. The crankshaft 20 can be such that crank journals 38, 38 can be rotatably supported by the crank casing 35 via ball bearings 39, 39. In addition, the crankshaft 20 can be rotatably supported on a front end side by the front crankcase cover 36 via a ball bearing 40.

A piston 46 can be connected to the crankshaft 20 via a connecting rod 43 and a crankpin 44. The piston 46 can be slidably fitted into a cylinder bore 47 of the cylinder block 32. A combustion chamber 59 can be defined between an upper surface of the piston 46 and the cylinder head 33 so as to communicate with an intake port 57 and an exhaust port 58 formed in the cylinder head 33. The intake valve 62 and the exhaust valve 63 open and close the intake port 57 and the exhaust port 58, respectively, via corresponding push rods 60 and rocker arms 61 driven by the rotation of a camshaft not shown.

A centrifugal clutch 65 is, in this example, attached in the crankcase cover 36 to a front end side of the crankshaft 20 via a one-way clutch 66.

The centrifugal clutch 65 includes a drive plate 67, a bowl-like clutch housing 69 and a clutch weight 70. The drive plate 67 can be secured to the crankshaft 20. The bowl-like clutch housing 69 coaxially covers the drive plate 67 so as to rotate along with a drive gear 68 attached to the crankshaft 20 for relative rotation. The clutch weight 70 can be pivotally supported for rotation by the drive plate 67 so as to be friction-engageable with the inner circumference of the clutch housing 69 in accordance with the action of the centrifugal force resulting from the rotation of the crankshaft 20. The one-way clutch 66 can be provided between the clutch housing 69 and the drive plate 67 so as to allow for power transmission from the drive gear 68 to the crankshaft 20.

A main shaft 72 can be rotatably supported by the crank casing 35 via ball bearings 73, 73 in parallel to the crankshaft 20. A multi-disk clutch 74 can be disposed at a front end portion of the main shaft 72. A clutch outer 75 of the clutch 74 can be provided with a driven gear 76 meshing with a drive gear 68 of the crankshaft 20. A clutch inner 77 of the clutch 74 can be connected to the main shaft 72 so as to be able to be integrally rotated. The clutch inner 77 and the clutch outer 75 can each be provided with a plurality of clutch discs 78. The plurality of clutch discs 78 of the clutch inner 77 and of the clutch outer 75 come into frictional contact with one another to transmit power from the crankshaft 20 to the main shaft 72. Incidentally, the main shaft 72 can be coaxially provided with a sub-shaft 80 at its front end portion. The sub-shaft 80 supports the clutch inner 77 via a ball bearing 79.

As shown in FIGS. 3-4, a counter shaft 82 is rotatably supported by the crank casing 35 via ball bearings 83, 84 in parallel to the crankshaft 20.

The main shaft 72 and the counter shaft 82 can be provided with a drive-side gear group 85 and a driven-side gear group 86 which can be selectively meshed with each other. The drive-side gear group 85 of the main shaft 72 and the driven-side gear group 86 of the counter shaft 82 constitute the transmission T.

An output shaft 88 adapted to transmit power to the front wheel FW and the rear wheel RW can be rotatably supported by the crank casing 35 via ball bearings 89, 89 in parallel to the crankshaft 20. The output shaft 88 can be provided with a driven gear 91 meshing with a drive gear 90 of the counter shaft 82.

A generator 92 can be connected in the rear crankcase 37 to a rear end portion of the crankshaft 20 and a starter motor 93 can be provided above the crankshaft 20 and connected to the rear end portion of the crankshaft 20. The generator 92 is, in this example, composed of an outer rotor 94 rotating along with the crankshaft 20 and a stator 95 secured to the rear crankcase 37. A gear 96 can be connected to the output shaft of a starter motor 93. This gear 96 may be connected to the crankshaft 20 via a driven gear 97 provided on the crankshaft 20, a one-way clutch 98 and an outer rotor 94 of the generator 92.

Incidentally, the generator 92 can be housed in a generator chamber 99 resulting from partitioning the inside of the rear crankcase 37 by a partition wall 100.

A joint housing chamber 102 can be defined adjacently to the generator chamber 99 and rearward of the partition wall 100 by partitioning the rear crankcase 37 by means of the partition wall 100. A joint 103 can be housed in the join housing chamber 102. In addition, a rotating shaft 101 of the supercharger 45 can be coaxially connected via the joint 103 to the rear end of the crankshaft 20. The joint 103 can be such that a drive coupler 104 on the side of the crankshaft 20 engages a driven coupler 105 on the side of the rotating shaft 101 of the supercharger 45 via an elastic member 106. Thus, the rotational drive force of the crankshaft 20 can be transmitted to the rotating shaft 101 of the supercharger 45. A balancer 107 can be attached to the driven coupler 105 to ensure the dynamic balance of the supercharger 45.

The supercharger 45, in the example shown in FIGS. 3-4, is a scroll-type compressor and is provided with a supercharger casing 109 joined to the rear crankcase 37 with bolts 108. An opening portion of the rear crankcase 37 can be closed by a bottom wall 109*a* described later of the supercharger casing 109 so as to define the joint housing chamber 102 between the partition wall 100 and the bottom wall 109*a*. Incidentally, the supercharger casing 109 has a fore-aft two-split structure whose both half-bodies can be integrally secured to each other by means of bolts not shown. The rotating shaft 101 connected to the crankshaft 20 by means of the joint 103 can be rotatably supported by the supercharger casing 109 at an end close to the crankshaft 20 by a ball bearing 110 and at an end opposite the crankshaft 20 by a needle bearing 111.

The crankshaft 20 can be internally formed with an intra-crankshaft oil-feed passage 112. The intra-crankshaft oil-feed passage 112 can be adapted to supply lubricating oil fed from a lubricating pump not shown to an inner circumferential portion of the drive gear 68 of the centrifugal clutch 65 and the periphery of the crankpin 44. Incidentally, the main shaft 72 and the output shaft 88 can be internally formed with an intra-main-shaft oil-feed passage 113 and an intra-output-shaft oil-feed passage 114, respectively.

Referring to FIG. 4, the supercharger casing 109 includes a pair of front and rear fixed scrolls 115F, 115R opposed to each other. An orbiting movable scroll 116 can be interposed between the front and rear fixed scrolls 115F, 115R.

The front fixed scroll 115F includes a spiral blade 119 and a spiral blade 120. The spiral blade 119 can be formed in an involute curve to extend rearward from the bottom wall 109*a* of the supercharger casing 109 along the axial direction of the rotating shaft 101 and has at ends sealing members 118 in contact with the front surface of a flat plate portion 117 of the movable scroll 116. The spiral blade 120 extends forward from a lid portion 109*b* of the supercharger casing 109 in the axial direction of the rotating shaft 101 and has sealing members 118 in contact with the rear surface of the flat plate portion 117 of the movable scroll 116.

Incidentally, the rotating shaft 101 can be rotatably supported at its front end portion by the bottom wall 109*a* of the supercharger casing 109 via the ball bearing 110 and at its rear end portion by the lid portion 109*b* of the supercharger casing 109 via the needle bearing 111.

The movable scroll 116 includes spiral blades 121, 121 in front and rear of the flat plate portion 117. The spiral blades 121, 121 can be formed in an involute curve and has at end portions sealing members 118 in contact with the bottom wall 109*a* and lid portion 109*b* of the front and rear fixed scrolls 115F, 115R. In addition, the movable scroll 116 includes a tubular boss portion 122 at its central portion. The spiral blades 121 of the movable scroll 116 can be orbitably assembled so as to mesh between the spiral blades 119, 120 of the front and rear fixed scrolls 115F, 115R.

The supercharger 45 includes three auxiliary rotating shafts (only one is depicted in FIGS. 3 and 4) 125 in addition to the rotating shaft 101 located at the central portion of the supercharger casing 109 described earlier. The three auxiliary rotating shafts 125 can be dividedly arranged by every 120 degrees on the periphery of the supercharger casing 109 in parallel to the rotating shaft 101. The rotating shaft 101 can be rotatably supported at both the ends by the supercharger casing 109 via the ball bearing 110 and the needle bearing 111 as described above and can be provided with an eccentric shaft portion 126 at a longitudinally general-central portion.

Incidentally, the eccentric shaft portion 126 can be formed with an axial bore 126*a* for rotary balance.

The auxiliary rotating shaft 125 can be rotatably supported by the supercharger casing 109 via a pair of ball bearings 127, 127. An auxiliary eccentric shaft 128 can be provided continuously with the rear end of the auxiliary rotating shaft 125 in a state of being cranked from the auxiliary rotating shaft 125. The auxiliary eccentric shaft 128 can be offset to be aligned with the eccentric direction of the eccentric shaft portion 126 of the rotating shaft 101. In addition, the auxiliary eccentric shaft 128 can be rotatably supported by the flat plate portion 117 of the movable scroll 116 via a pair of ball bearings 129, 129.

The internal circumference of the boss portion 122 of the movable scroll 116 can be pivotably fitted to the eccentric shaft portion 126 of the rotating shaft 101. Thus, the movable scroll 116 can be supported orbitaly without rotation relative to the eccentric shaft portion 126 of the rotating shaft 101. The auxiliary eccentric shaft 128 of the auxiliary rotating shaft 125 can be rotatably supported by the flat plate portion 117 of the movable scroll 116. In this way, the orbiting of the movable scroll 116 may be permitted. The eccentric shaft portion 126 of the rotating shaft 101 can be formed with a large-diameter portion 135 on the side of the crankshaft 20 and a small-diameter portion 131 extending from the large-diameter portion 135 to a rear end portion via a stepped portion d and having a small diameter. A pair of needle bearings 130, 130 can be interposed between the small-diameter portion 131 and the boss portion 122 of the movable scroll 116.

The movable scroll 116 can be driven in an orbit motion by the rotational shaft 101 and the auxiliary rotating shafts 125. As a compression chamber defined among the fixed side spiral blade 119, the movable side spiral blades 121, 121, and the bottom wall 109*a* and lid portion 109*b* opposed to each other of the supercharger casing 109 can be reduced in volume, it can be sequentially shifted from the outer circumferential side to the central side. Air sucked into the most outer circumferential compression chamber from the intake port 45*i* can be gradually compressed, finally to high pressure at the central portion, and can be discharged from the central discharge port 45*e* of the rear end side rear fixed scroll 115R.

A small inner-diameter portion 132 can be formed inside the boss portion 122 of the movable scroll 116 at a position corresponding to the location of the needle bearing 130. In addition, a large inner-diameter portion 133 can be formed on both the sides of the small inner-diameter portion 132. Further, a seal attachment portion 134 greater in diameter than the large inner-diameter portion 133 can be formed at the opening portion at each of the front and rear ends of the boss portion 122 so as to correspond to each of the large-diameter portions 135 of the eccentric shaft portion 126.

Copper bushes 136 for positioning the movable scroll 116 relative to the eccentric shaft portion 126 can be attached on the front side and rear side of the corresponding needle bearings 130, 130. In addition, shims 137 can be attached on the front side and rear side of the corresponding copper bushes 136. A front shim 137 can be positioned by the stepped portion d. A rear shim 137 can be positioned by a circlip 138, or other suitable fastener, adjacent thereto on the side opposite the crankshaft 20.

Oil seals 139 can be disposed at both ends of the boss portion 122 of the movable scroll 116. A front oil seal 139 can be supported by the boss portion 122 of the movable scroll 116 to seal between the large-diameter portion 135 of the eccentric shaft portion 126 of the rotating shaft 101 and the seal attachment portion 134 at the front portion of the boss portion 122. Also a rear oil seal 139 can be supported by the boss portion 122 of the movable scroll 116 to seal between the small-diameter portion 131 of the eccentric shaft portion 126 of the rotating shaft 101 and the seal attachment portion 134 at the rear portion of the boss portion 122.

The lid portion 109*b* at the rear end portion of the supercharger casing 109 can be provided with the intake port 45*i* at an external upper portion and with the discharge port 45*e* at the central portion of the lid portion 109*b* and on the circumference of the needle bearing 111. The discharge port 45*e* communicates with the circumference of the boss portion 122 of the movable scroll 116. The intake port 45*i* can be connected to the air cleaner 41 via the intake connection pipe 42. The discharge port 45*e* can be connected to the intake side expansion chamber 501 of the intercooler 50 (see FIG. 2) via the discharge connection pipe 48 and the connection pipe 49.

The rotating shaft 101 can be internally formed with an intra-rotating-shaft oil-feed passage 123 extending along the longitudinal direction of the rotating shaft 101. A connection pipe 140 can be disposed in the intra-crankshaft oil-feed passage 112 of the crankshaft 20 and in an intra-rotating-shaft oil-feed passage 123 of the rotating shaft 101. The connection pipe 140 can be sealed at its external circumferential surface by oil seals 141, 141 and a bush 156 at the rear end portion of the intra-crankshaft oil-feed passage 112. The oil seals 141, 141 can be provided at the rear end portion of the intra-crankshaft oil-feed passage 112 of the crankshaft 20 and the front end portion of the intra-rotating-shaft oil-feed passage 123 of the rotating shaft 101. In addition, the connection pipe 140 extends from the rear end portion of the crankshaft 20 to the rear end portion of the rotating shaft 101. An annular extra-connection-pipe oil-feed passage 142 can be formed in the rotating shaft 101 and on the circumference of the connection pipe 140. The extra-connection-pipe oil-feed passage 142 can be communication-connected to the intra-connection-pipe oil-feed passage 144 in the connection pipe 140, i.e., to the intra-crankshaft oil-feed passage 112 via a communication hole 143 formed at the rear end portion of the connection pipe 140.

In this way, the intra-connection-pipe oil-feed passage 144 and the extra-connection-pipe oil-feed passage 142 communicate with each other on a side opposite the crankshaft 20 with the needle bearings 130, 130 disposed therebetween.

The small-diameter portion 131 of the rotating shaft 101 can be provided with four oil passages 145 opening toward the two needle bearings 130, 130 and between the copper bushes 136 and the corresponding shims 137.

The rotating shaft 101 can be formed with an oil passage 146 extending from the intra-rotating-shaft oil-feed passage 123 toward a position along the rear lateral surface of the ball bearing 110 of the rotating shaft 101. An oil seal 147 can be attached between the rotating shaft 101 and the opening portion of the bottom wall 109*a* of the supercharger casing 109. This oil seal 147 prevents lubricating oil from entering the inside of the supercharger casing 109 and supplies lubricating oil to the ball bearing 110 from the oil passage 146.

The bottom wall 109*a* of the supercharger casing 109 can be formed with a communication passage 149. The joint housing chamber 102 can be formed with a lubricating oil return passage 148 opening toward the outer rotor 94 of the generator 92 in the generator chamber 99. The communication passage 149 and the lubricating oil return passage 148 can be communication-connected to each other and the communication passage 149 communicates with the oil passage 146.

In this way, the extra-connection-pipe oil-feed passage 142 communicates on the downstream side thereof, i.e., on the rear end side thereof with the lubricating oil return passage 148 via the oil passage 146 and the communication passage 149. Incidentally, a connection member 152 can be provided at a mating surface between the connection passage 149 and the lubricating oil return passage 148 and in a connection portion between the joint housing chamber 102 and the bottom wall 109*a* of the supercharger casing 109, which can be a connection portion between the communication passage 149 and the lubricating oil return passage 148.

On the other hand, the communication hole 143 of the connection pipe 140 opens at the location of the needle bearing 111 located at the rear end portion of the rotating shaft 101. In addition, an oil passage 150 can be formed at a position corresponding to the location of the communication hole 143 so as to extend from the intra-rotating-shaft oil-feed passage 123 and open at an external circumferential surface of the rotating shaft 101. Incidentally, an oil seal 151 can be attached adjacently to the needle bearing 111 on the side of the crankshaft 20 to prevent lubricating oil from entering the inside of the supercharger casing 109.

According to the first embodiment described above, the lubricating oil supplied from the front end of the crankshaft 20 to the intra-crankshaft oil-feed passage 112 reaches the rear end portion of the crankshaft 20. Then, the lubricating oil can be prevented by the front oil seal 141 from entering the extra-connection-pipe oil-feed passage 142 but supplied to the intra-connection-pipe oil-feed passage 144 which can be the inside of the connection pipe 140 from the front end portion to rear end portion side of the connection pipe 140. Further, the lubricating oil flowing from the communication hole 143 located at the rear end portion reaches the extra-connection-pipe oil-feed passage 142. Then, the lubricating oil flows in the extra-connection-pipe oil-feed passage 142 toward the front end portion of the connection pipe 140 on this occasion.

During this time, the lubricating oil can be supplied from the oil passage 150 to the needle bearing 111, and from the oil passages 145 to the needle bearings 130, 130, the copper bush 136 and the shims 137. In addition, the lubricating oil can be supplied from the oil passage 146 via the ball bearing 110 and from the communication passage 149 and the lubricating oil return passage 148 to the generator 92.

Thus, the rotary motion of the rotating shaft 101 of the supercharger 45 with respect to the supercharger casing 109 and the orbiting motion of the movable scroll 116 resulting from the eccentric rotation of the eccentric shaft portion 126 can smoothly be performed in a sufficiently lubricated state without the use of external piping, thereby allowing for simplified piping. In addition, piping length can be reduced compared with the case where external piping can be arranged to supply lubricating oil; therefore, sufficient oil-feed can be performed although the lubricating oil pump of the internal combustion engine E has small power.

Specifically, the two passages, i.e., the intra-connection-pipe oil-feed passage 144 inside the connection pipe 140 disposed in the rotating shaft 101 and the extra-connection-pipe oil-feed passage 142 outside the connection pipe 140 can be formed in the intra-rotating-shaft oil-feed passage 123 which can be the inside of the rotating shaft 101. These two passages can be allowed to communicate with the lubricating oil return passage 148 via the communicating passage 149 through the oil passage 146 on the front end portion side of the connection pipe 140, i.e., on the downstream side of the extra-connection-pipe oil-feed passage 142. Thus, the lubricating oil passage adapted to return lubricating oil toward the internal combustion engine E can be simplified.

The intra-connection-pipe oil-feed passage 144 and the extra-connection-pipe oil-feed passage 142 may be allowed to communicate with each other through the communicating hole 143 located on the side opposite the crankshaft 20 with the needle bearings 130, 130 of the rotating shaft 101 put therebetween. Lubricating oil passes through the oil passage 145 adapted to feed oil to the needle bearings 130, 130 and thereafter flows toward the internal combustion engine E. Thus, the needle bearings 130, 130 can reliably be lubricated.

Further, the position of the communication hole 143 can be set at the location of the needle bearing 111 supporting the rear end portion of the rotating shaft 101. Lubricating oil passes through the needle bearing 111 of the rotating shaft 101 before it flows toward the internal combustion engine E. Thus, the lubricating oil can reliably be fed to the needle bearing 111.

Although partitioned by the portion wall 100, the generator 92 can be disposed adjacently to the joint 103 on the crankshaft 20. In addition, the lubricating oil return passage 148 can be opened toward the outer rotor 94 of the generator 92. Thus, the oil-supply passage for cooling the generator 92 can be simplified.

The bottom wall 109*a* of the supercharger casing 109 can be joined to the rear crankcase 37 of the internal combustion engine E, i.e., to the crank casing 35. In addition, the crank casing 35 and the supercharger casing 109 define the joint housing chamber 102 housing the joint 103. Thus, the joint 103 can easily be protected by the crank casing 35 and the supercharger casing 109.

The joint housing chamber 102 can be adjacent to the generator chamber 99 housing the generator 92 provided in the rear crankcase 37 of the crank casing 35. In addition, the lubricating oil return passage 148 can be formed in the joint housing chamber 102. Thus, the lubricating oil return passage 148 can be shortened and simply formed.

A second embodiment (including a modified example of FIG. 5) of the present invention will next be described with reference to FIG. 5 while using FIGS. 1 and 2 and partially FIG. 3. In FIG. 5, only portions needed for explanation in the same portions as those in the first embodiment are denoted with reference symbols. FIG. 5 is a cross-sectional view of the second embodiment of the present invention, corresponding to FIG. 4.

In the second embodiment, a connection pipe 140' can be formed by elongating the front end portion of the connection pipe 140 on the side of the crankshaft 20 in the first embodiment to the location of a generator 92. Oil seals 141, 141 and a bush 156 can be provided at a joint portion between the crankshaft 20 and the rotating shaft 101. The oil seals 141, 141 seal the external circumference of a pipe member 153 inserted into the connection pipe 140'. An intra-connection-pipe oil-feed passage 144 can be ensured over the full length of the connection pipe 140'. A sealing member 160 can be disposed at the location of the generator 92 and between the external circumference of the front end portion of the connection pipe 140' and an inner wall of an intra-crankshaft oil-feed passage 112 to block the extra-connection-pipe oil-feed passage 142.

In the present embodiment, a lubricating return passage 161 can be provided in place of the communication passage 149 and the lubricating oil return passage 148 in the first embodiment. The lubricating return passage 161 extends from an intra-crankshaft oil-feed passage 112 of the crankshaft 20 close to the front end portion of the connection pipe 140' and opens in the external circumferential surface of the crankshaft 20. The lubricating oil return passage 161 opens toward the generator 92, specifically, toward an outer rotor 94 of the generator 92. In addition, the lubricating return passage 161 communicates with a generator chamber 99 via a radial opening portion 162 provided in a shaft portion 94' of the outer rotor 94.

With this, according to the second embodiment, lubricating oil supplied to the intra-crankshaft oil-feed passage 112 of the crankshaft 20 can be prevented by the sealing member 60 from entering the extra-connection-pipe oil-feed passage 142 and supplied in the intra-connection-pipe oil-feed passage 144, i.e., the inside of the connection pipe 140', from the front end portion to rear end portion side of the connection pipe 140'. Then, the lubricating oil flows from the communication hole 143 located at the rear end portion and reaches the extra-connection-pipe oil-feed passage 142. Further, the lubricating oil passes through the extra-connection-pipe oil-feed passage 142 toward the front end portion side of the connection pipe 140' on this occasion. During this time, the lubricating oil can be supplied from the oil passage 150 to the needle bearing 111, from the oil passage 145 to the needle bearings 130, 130, the copper bush 136 and the shims 137 and from the oil passage 146 to the ball bearing 110.

Consequently, the rotary motion of the rotating shaft 101 of the supercharger 45 with respect to the supercharger casing 109 and the orbiting motion of the movable scroll 116 resulting from the eccentric rotation of the eccentric shaft portion 126 can smoothly be performed in a sufficiently lubricated state without the use of external piping, thereby allowing for simplified piping. In addition, piping length can be reduced compared with the case where external piping can be arranged to supply lubricating oil; therefore, sufficient oil-feed can be performed although the lubricating oil pump of the internal combustion engine E has small power.

In particular, in the second embodiment, the two passages, i.e., the intra-connection-pipe oil-feed passage 144 inside the connection pipe 140' disposed in the rotating shaft 101 and the extra-connection-pipe oil-feed passage 142 outside the connection pipe 140' can be formed in the intra-rotating-shaft oil-feed passage 123 which can be the inside of the rotating shaft 101. The extra-connection-pipe oil-feed passage 142 can be allowed to communicate with the lubricating oil return passage 161. Therefore, it may not be necessary to form the communication passage 149 in the bottom wall 109*a* of the supercharger casing 109 unlike the first embodiment. Thus, the lubricating oil passage adapted to return lubricating oil toward the internal combustion engine E can be simplified according to the fact that the lubricating oil does not need to pass through the communication passage 149.

The intra-connection-pipe oil-feed passage 144 and the extra-connection-pipe oil-feed passage 142 may be allowed to communicate with each other via the communication hole 143 located on a side opposite the crankshaft 20 with the needle bearings 130, 130 put therebetween. In this way, lubricating oil passes through oil passage 145 adapted to feed oil to the needle bearings 130, 130 before flowing toward the internal combustion engine E. Thus, the needle bearing 130, 130 can reliably be lubricated. The position of the communication hole 143 can be set at the location of the needle bearing 111 supporting the rear end portion of the rotating shaft 101. Therefore, lubricating oil passes through the needle bearing 111 of the rotating shaft 101 before flowing toward the internal combustion engine E. Thus, oil can reliably be supplied to the needle bearing 111. Although partitioned by the partition wall 100, the generator 92 can be disposed adjacently to the joint 103 on the crankshaft 20 and the lubricating oil return passage 161 opens toward the generator 92. Thus, the oil supply passage for cooling the generator 92 can be simplified. The bottom wall 109*a* of the supercharger casing 109 can be joined to the rear crankcase 37 of the internal combustion engine E, i.e., to the crankcase 35 and the crank casing 35 and the supercharger casing 109 defines the joint housing chamber 102 housing the joint 103. Thus, the joint 103 can easily be protected by the crank casing 35 and the supercharger casing 109. These points may be similar to the first embodiment.

Figure 6:
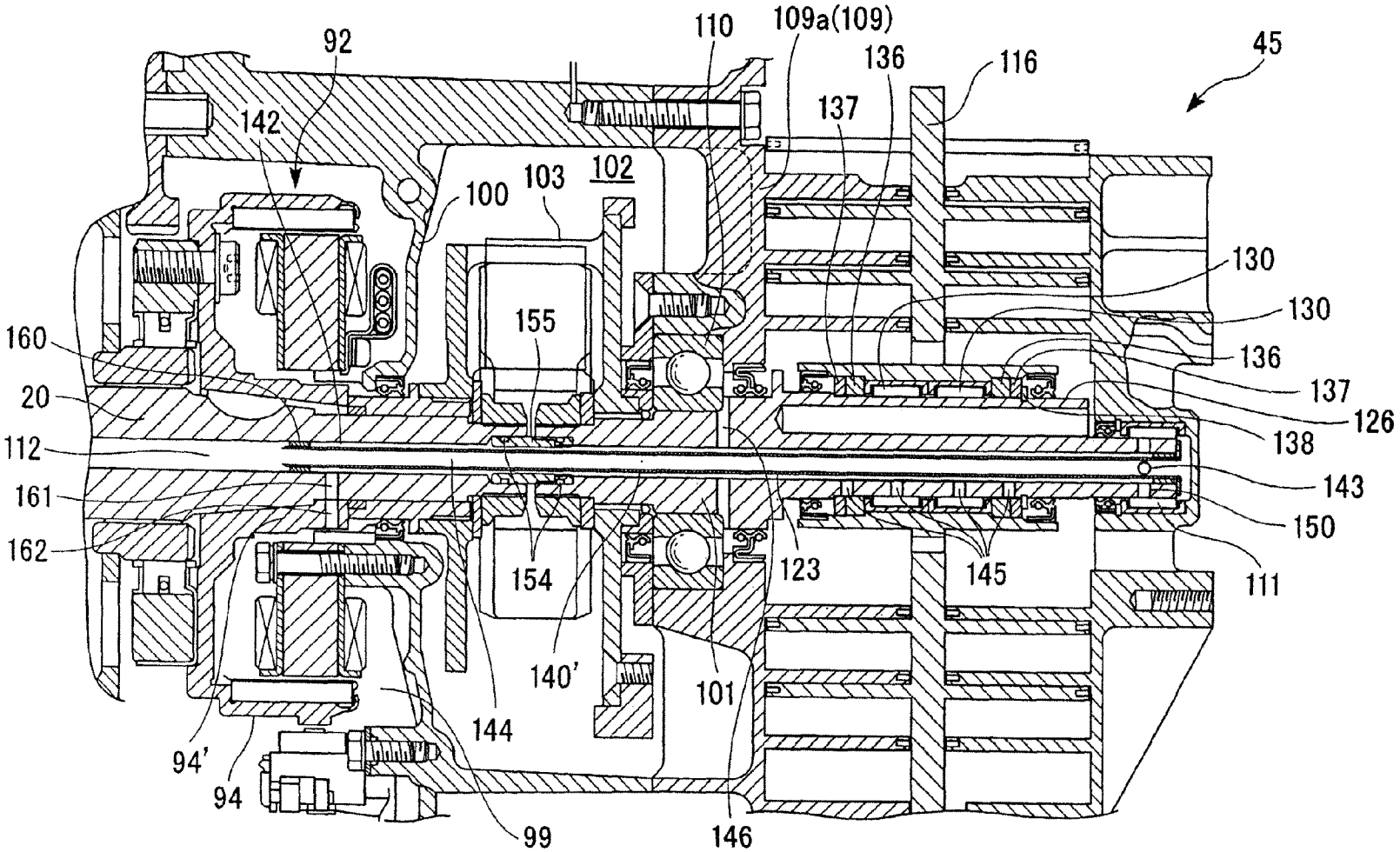
FIG. 6 is a cross-sectional view corresponding to FIG. 5, illustrating a modification of the second embodiment.

A modified example of the second embodiment is illustrated in FIG. 6. The oil seals 141, 141 in the second embodiment may be cancelled and instead a collar 155 straddling both the rear end opening of the crankshaft 20 and the inner circumferential surface of the front end opening portion of the rotating shaft 101 may be provided so as to be sealed by means of O-rings 154, 154 and the extra-connection-pipe oil-feed passage 142 may be ensured continuously from the crankshaft 20 to the rotating shaft 101. With this, the use of only the collar 155 with the O-rings 154 may be required, which may reduce the number of component parts.

Incidentally, the present invention is not limited to the embodiments described above. For example, the present invention can be applied not only to four-wheeled straddle-ride type vehicles but also to two-wheeled vehicles and three-wheeled straddle-ride vehicles, as well as to straddle-ride type small-sized planing boats. Although the structure provided with the front and rear fixed scrolls 115F, 115R can be taken as an example, the invention can be applied also to a supercharger structured to have a single fixed scroll.

Figure 7:
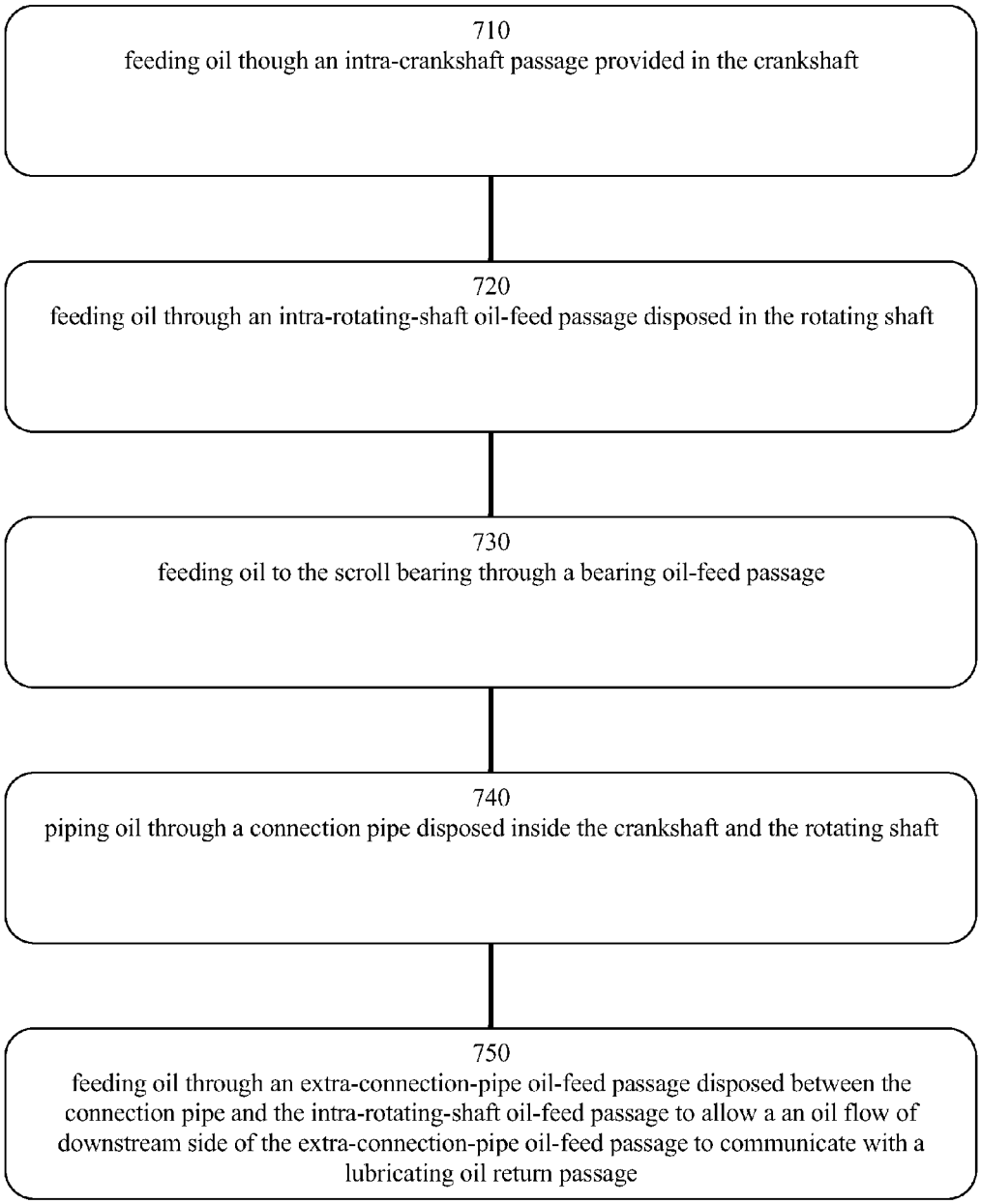
FIG. 7 illustrates a method according to certain embodiments of the present invention.

FIG. 7 illustrates a method according to certain embodiments of the present invention. The method shown in FIG. 7 may be useful for lubricating a supercharger, such as one of the superchargers discussed above. The method can include feeding 710 oil though an intra-crankshaft passage provided in the crankshaft, wherein a support bearing is disposed on the fixed scroll so as to support the rotating shaft. The method can also include feeding 720 oil through an intra-rotating-shaft oil-feed passage disposed in the rotating shaft. The method can further include feeding 730 oil to the scroll bearing through a bearing oil-feed passage, wherein the bearing oil-feed passage is configured to bring the intra-rotating-shaft oil-feed passage, the support bearing, and the scroll bearing into communication with one another. The method can additionally include piping 740 oil through a connection pipe disposed inside the crankshaft and the rotating shaft, wherein the intra-crankshaft oil-feed passage is communication-connected to the intra-rotating-shaft oil-feed passage via an intra-connection-pipe oil-feed passage disposed inside the connection pipe. Optionally, the method can further include feeding 750 oil through an extra-connection-pipe oil-feed passage disposed between the connection pipe and the intra-rotating-shaft oil-feed passage to allow a an oil flow of downstream side of the extra-connection-pipe oil-feed passage to communicate with a lubricating oil return passage.

One having ordinary skill in the art will readily understand that the invention as discussed above may be practiced with steps in a different order, and/or with hardware elements in configurations which are different than those which are disclosed. Therefore, although the invention has been described based upon these preferred embodiments, it would be apparent to those of skill in the art that certain modifications, variations, and alternative constructions would be apparent, while remaining within the spirit and scope of the invention. In order to determine the metes and bounds of the invention, therefore, reference should be made to the appended claims.

REFERENCE SYMBOLS USED

20 Crankshaft
31 Crankcase
45 Supercharger
57 Intake port
92 Generator
99 Generator chamber
101 Rotating shaft
102 Joint housing chamber
103 Joint
109 Supercharger casing (casing)
110 Ball bearing (support bearing)
111 Needle bearing (support bearing)
112 Intra-crankshaft oil-feed passage
115F Front fixed scroll
115R Rear fixed scroll
116 Movable scroll
123 Intra-rotating-shaft oil-feed passage
126 Eccentric shaft portion
130 Needle bearing (scroll bearing)
140, 140' Connection pipe
142 Extra-connection-pipe oil-feed passage
143 Communication hole (communication portion)
144 Intra-connection-pipe oil-feed passage
145, 146, 150 Oil passage (bearing oil-feed passage)
148, 161 Lubricating oil return passage
E Internal combustion engine

We claim:

1. A supercharger lubricating structure for an internal combustion engine, wherein a supercharger includes a rotating shaft connected to a crankshaft via a joint, an eccentric shaft portion provided on the rotating shaft, a movable scroll provided on the eccentric shaft portion so as to be orbited via a scroll bearing, and a fixed scroll provided to correspond to the movable scroll, wherein the movable scroll and the fixed scroll are configured to supply compressed air to an intake port of the internal combustion engine, the supercharger lubricating structure for an internal combustion engine comprising:

an intra-crankshaft oil-feed passage disposed in the crankshaft;

a support bearing provided on the fixed scroll so as to support the rotating shaft;

an intra-rotating-shaft oil-feed passage disposed in the rotating shaft;

a bearing oil-feed passage configured to bring the intra-rotating-shaft oil-feed passage, the support bearing, and the scroll bearing into fluid flow communication with one another;

an extra-connection-pipe oil-feed passage disposed between the connection pipe and the intra-rotating-shaft oil-feed passage to allow a downstream side of the extra-connection-pipe oil-feed passage to fluid flow communicate with a lubricating oil return passage; and a connection pipe disposed inside the crankshaft and the rotating shaft, wherein the intra-crankshaft oil-feed passage is fluid flow communication-connected to the intra-rotating-shaft oil-feed passage via an intra-connection-pipe oil-feed passage disposed inside the connection pipe, and wherein the extra-connection-pipe oil-feed passage and the intra-rotating-shaft oil-feed passage are coaxial.

2. The supercharger lubricating structure for the internal combustion engine according to claim 1, wherein the intra-connection-pipe oil-feed passage and the extra-connection-pipe oil-feed passage are configured to fluid flow communicate with each other on a side opposite the crankshaft with the scroll bearing put between the intra-connection-pipe oil-feed passage and the extra-connection-pipe oil-feed passage.

3. The supercharger lubricating structure for the internal combustion engine according to claim 2, further comprising:

a communication portion configured to allow the intra-connection-pipe oil-feed passage and the extra-connection-pipe oil-feed passage to fluid flow communicate with each other is set at a position of the support bearing of the rotating shaft on a side opposite the crankshaft with the scroll bearing put therebetween.

4. The supercharger lubricating structure for the internal combustion engine according to claim 1, wherein a generator is disposed adjacently to the joint on the crankshaft, wherein the lubricating oil return passage opens toward the generator.

5. The supercharger lubricating structure for the internal combustion engine according to claim 1, wherein a casing of the supercharger is joined to a crankcase of the internal combustion engine at a joint, wherein the crankcase and the casing of the supercharger define a joint housing chamber housing the joint therein.

6. The supercharger lubricating structure for the internal combustion engine according to claim 5, wherein the joint housing chamber is adjacent to a generator chamber provided in the crankcase to house the generator therein and the lubricating oil return passage is disposed in the joint housing chamber.

7. A supercharger lubricating structure for an internal combustion engine, wherein a supercharger includes a rotating shaft connected to a crankshaft via a joint, an eccentric shaft portion provided on the rotating shaft, a movable scroll provided on the eccentric shaft portion so as to be orbited via a scroll bearing, and a fixed scroll provided to correspond to the movable scroll, wherein the movable scroll and the fixed scroll are configured to supply compressed air to an intake port of the internal combustion engine, the supercharger lubricating structure for an internal combustion engine comprising:

crankshaft passage means for feeding oil within the crankshaft, wherein the crankshaft passage means is provided in the crankshaft;

bearing means for supporting the rotating shaft provided on the fixed scroll;

rotating-shaft passage means for feeding oil within the rotating shaft, wherein the rotating-shaft passage means is disposed in the rotating shaft;

bearing passage means for feeding oil to the scroll bearing, wherein the bearing passage means is configured to bring the rotating-shaft passage means, the bearing means, and the scroll bearing into fluid flow communication with one another;

a second connection means for feeding oil outside the connection means disposed between the connection means and the rotating-shaft passage means to allow a downstream side of the second connection means to fluid flow communicate with return passage means for returning lubricating oil; and connection means for piping oil, wherein the connection means is disposed inside the crankshaft and the rotating shaft, wherein the crankshaft passage means is fluid flow communication-connected to the rotating-shaft passage means via connection passage means for feeding oil within the connection means is disposed inside the connection means, and wherein the second connection means and the rotating-shaft passage means are coaxial.

8. The supercharger lubricating structure for the internal combustion engine according to claim 7, wherein the connection passage means and the second connection means are configured to fluid flow communicate with each other on a side opposite the crankshaft with the scroll bearing put therebetween.

9. The supercharger lubricating structure for the internal combustion engine according to claim 8, further comprising:

a communication portion means for allowing the connection passage means and the second connection means to fluid flow communicate with each other is set at a position of the bearing means of the rotating shaft on a side opposite the crankshaft with the scroll bearing put between allowing the connection passage means and the second connection means.

10. The supercharger lubricating structure for the internal combustion engine according to claim 7, wherein a generator is disposed adjacently to the joint on the crankshaft, and the return passage means opens toward the generator.

11. The supercharger lubricating structure for the internal combustion engine according to claim 7, wherein a casing of the supercharger is joined to a crankcase of the internal combustion engine at a joint, wherein the crankcase and the casing of the supercharger define a joint housing chamber housing the joint therein.

12. The supercharger lubricating structure for the internal combustion engine according to claim 11, wherein the joint housing chamber is adjacent to a generator chamber provided in the crankcase to house the generator therein and the return passage means is disposed in the joint housing chamber.

13. A method for lubricating a supercharger for an internal combustion engine, wherein a supercharger includes a rotating shaft connected to a crankshaft via a joint, an eccentric shaft portion provided on the rotating shaft, a movable scroll provided on the eccentric shaft portion so as to be orbited via a scroll bearing, and a fixed scroll provided to correspond to the movable scroll, wherein the movable scroll and the fixed scroll are configured to supply compressed air to an intake port of the internal combustion engine, the method comprising:

feeding oil though an intra-crankshaft passage provided in the crankshaft, wherein a support bearing is disposed on the fixed scroll so as to support the rotating shaft;

feeding oil through an intra-rotating-shaft oil-feed passage disposed in the rotating shaft;

feeding oil to the scroll bearing through a bearing oil-feed passage, wherein the bearing oil-feed passage is configured to bring the intra-rotating-shaft oil-feed passage, the support bearing, and the scroll bearing into fluid flow communication with one another;

feeding oil through an extra-connection-pipe oil-feed passage disposed between the connection pipe and the intra-rotating-shaft oil-feed passage to allow an oil flow of a downstream side of the extra-connection-pipe oil-feed passage to fluid flow communicate with a lubricating oil return passage; and piping oil through a connection pipe disposed inside the crankshaft and the rotating shaft, wherein the intra-crankshaft oil-feed passage is fluid flow communication-connected to the intra-rotating-shaft oil-feed passage via an intra-connection-pipe oil-feed passage disposed inside the connection pipe, wherein the extra-connection-pipe oil-feed passage and the intra-rotating-shaft oil-feed passage are coaxial.

* * * * *